US005192363A

United States Patent [19]

Bussell et al.

[11] Patent Number: 5,192,363

[45] Date of Patent: Mar. 9, 1993

[54] PAPER SIZING COMPOSITIONS

[75] Inventors: William R. Bussell; Nicholas S. Morgan, both of Bristol, United Kingdom

[73] Assignee: EKA Nobel Landskrona AB, Landskrona, Sweden

[21] Appl. No.: 753,401

[22] Filed: Aug. 30, 1991

Related U.S. Application Data

[63] Continuation of Ser. No. 499,562, Mar. 26, 1990, abandoned, which is a continuation of Ser. No. 194,381, May 16, 1988, abandoned.

[30] Foreign Application Priority Data

May 26, 1987 [GB] United Kingdom ..... 8712370

[51] Int. Cl.[5] ..... C08C 89/00

[52] U.S. Cl. ..... 106/218; 162/180

[58] Field of Search ..... 106/218, 238, 236; 162/180, 181.3, 181.2, 238

[56] References Cited

U.S. PATENT DOCUMENTS

| | | | |
|---|---|---|---|
| 2,138,325 | 11/1938 | Nivling | 162/158 |
| 3,817,768 | 6/1974 | Aldrich | 106/238 |
| 3,906,142 | 9/1975 | Dowthwaite et al. | 162/180 |
| 3,966,654 | 6/1976 | Aldrich | 162/164.3 |
| 4,022,634 | 5/1977 | Emerson et al. | 106/218 |
| 4,025,354 | 5/1977 | Emerson et al. | 106/236 |
| 4,093,779 | 6/1978 | Emerson et al. | 428/411 |
| 4,141,750 | 2/1979 | Emerson et al. | 106/218 |
| 4,147,682 | 4/1979 | Yada | 162/168.3 |
| 4,157,982 | 6/1979 | Clemons et al. | 162/180 |
| 4,199,367 | 4/1980 | Smith | 106/168 |
| 4,203,776 | 5/1980 | Greiner | 106/238 |
| 4,309,388 | 1/1982 | Tenney et al. | 422/304 |
| 4,323,425 | 4/1982 | Dowthwaite et al. | 162/168.2 |
| 4,333,795 | 6/1982 | Street | 162/180 |
| 4,437,894 | 3/1984 | Emerson | 162/180 |
| 4,505,754 | 3/1985 | Gowan, Jr. | 162/180 |
| 4,522,686 | 6/1985 | Dumas | 162/158 |
| 4,544,608 | 10/1985 | Nishi et al. | 106/238 |
| 4,605,445 | 8/1986 | Abell et al. | 162/180 |
| 4,743,303 | 5/1988 | Helmer et al. | 106/236 |
| 4,745,097 | 5/1988 | Mackawa et al. | 427/152 |
| 4,816,073 | 3/1989 | Helmer et al. | 162/164.1 |
| 4,878,999 | 11/1989 | Gowan, Jr. | 162/180 |
| 4,983,257 | 1/1991 | Schultz et al. | 162/180 |

FOREIGN PATENT DOCUMENTS

| | | |
|---|---|---|
| 0018007 | 10/1980 | European Pat. Off. . |
| 0145686 | 6/1985 | European Pat. Off. . |
| 0159794 | 10/1985 | European Pat. Off. . |
| 0181847 | 5/1986 | European Pat. Off. . |
| 8602677 | 5/1986 | PCT Int'l Appl. . |
| 851187 | 10/1960 | United Kingdom . |
| 1444751 | 8/1976 | United Kingdom . |
| 2050453 | 1/1981 | United Kingdom . |
| 2159183 | 11/1985 | United Kingdom . |

OTHER PUBLICATIONS

Notes of the Technical Association of the Pulp and Paper Industry, 1983 Sizing Seminar, Savannah, Ga. Nov. 16-18, 1983, pp. 61-65, Tappi Press, Atlanta, Ga. U.S.; D. R. Dill: "Dispersed rosin sizes: why and how".

*Primary Examiner*—Mark L. Bell
*Assistant Examiner*—Aiaul Wright
*Attorney, Agent, or Firm*—Frishauf, Holtz, Goodman & Woodward

[57] ABSTRACT

A one-shot paper sizing composition is in the form of an aqueous dispersion containing a rosin component, a co-reactant therefor, such as an aluminium chlorohydrate, and an amine or an amine salt of a rosin acid.

22 Claims, No Drawings

PAPER SIZING COMPOSITIONS

This application is a continuation of application Ser. No. 07/499,562, filed Mar. 26, 1990, (abandoned) which is a continuation of application Ser. No. 07/194,381 filed May 16, 1988 (abandoned).

This invention relates to paper sizing compositions, methods for making such compositions, processes for sizing paper products using these compositions and paper products which have been sized with these compositions.

Stable dispersions of rosin or rosin-based products are well-known and have long been used, especially as sizing agents in the manufacture of paper. In this specification, the term "paper" is used, for convenience, to mean all forms of paper, paperboard and related products whose manufacture involves the employment of a sizing agent upon cellulosic or other fibres. Paper sizing agents are usually employed either by being added to the cellulosic or other fibre stock from which a web is later made or by being applied to the surface after the web has been formed. Rosin-based sizing agents depend for their sizing effect upon the formation of electrostatic bonds between the sizing agent and the cellulosic or other fibres of the paper stock or web. Highly efficient sizing agents have been developed more recently which include many kinds which, in use, form chemical bonds and these are thus known as "reactive" sizing agents. A major development in the paper-making size art was the discovery that reaction products formed by rosin or unsaturated compounds present in rosin, on the one hand, and unsaturated carboxylic acids or their anhydrides, especially maleic or fumaric acid or maleic anhydride, on the other hand, have greatly enhanced sizing efficiency, as compared with those kinds of sizing agents which are essentially dispersions of rosin itself. These so-called "maleated" rosin reaction products and other related sizing agents are rather expensive to make and so they are often used to fortify conventional rosin dispersions, rather than to replace them. This is done by adding a quantity of a "maleated" rosin reaction product to a conventional rosin dispersion and the resultant compositions are commonly known as "fortified sizing agents."

In practice, all types of paper sizing agents are usually in the form of stable dispersions and they cause sizing by depositing rosin-based or other materials on to the fibre stock or the paper web, so that sizing essentially involves breaking the stable dispersion. This can occur on contact between the dispersion and the stock or web, where the latter is effective to destroy the stability of the dispersion. Usually, however, adequate sizing does not arise from mere contact of the paper sizing agent with the paper stock or web. Instead, it requires the presence of a co-reactant to break the dispersion and so cause the desired deposition of sizing components on the fibres of the paper stock or web. The most commonly employed co-reactants are aluminium compounds and, especially, aluminium sulphate, papermaker's alum and the polyaluminium chlorides.

The majority of paper-making processes involve the separate addition or application of the rosin-based size and a co-reactant to the paper stock or the paper web. There have been proposals, notably those in U.K. Patent Applications 2050453A and 2159183A and U.S. Pat. No. 4,522,686, to prepare sizing compositions comprising both a rosin component and a suitable reactant, which compositions offer the advantage of sizing using a single composition, but these have not been entirely successful, either because the dispersions are unstable or because their effectiveness as a size has been reduced. For whatever reason, the majority of paper mills utilise a sizing process which involves the use of two separate components, despite the inherent difficulties involved.

It has been discovered that dispersions, comprising a rosin component and a co-reactant, which are stable and which impart excellent sizing properties to paper, can be prepared by the incorporation into a suitable composition of an amine or an amine salt of a rosin acid.

According to one aspect of the present invention, therefore, a paper sizing composition is provided which comprises an aqueous dispersion containing a rosin size component, a co-reactant and an amine or an amine salt of a rosin acid.

Rosin is a solid resinous material which occurs naturally in the oleoresin of pine trees. It is obtained from one of three main sources, the oleoresin exudate of living pine trees, the oleoresin contained in the aged stumps of pine trees and from the tall oil produced as a by-product in the kraft paper industry. Rosin is a complex mixture of cyclic terpene carboxylic acids together with a small amount of non-acidic components. A major constituent of rosin is the tricylic doubly unsaturated mono-carboxylic acid, abietic acid.

Abietic acid undergoes Diels-Alder addition with dienophiles. Rosin may therefore be reacted with dienophilic carboxylic acids such as maleic acid, maleic anhydride or fumaric acid to form a tetracyclic polycarboxylic acid. This reaction with these dienophiles is commonly termed fortification. The product of such reaction between rosin and a dienophile is commonly termed a fortified rosin. Fortified rosin dispersions are used as sizing compositions in the paper sizing industry and the novel dispersions of this invention may comprise either rosin or fortified rosin or a mixture of the two. The rosin may have been treated with formaldehyde in order to enhance their stability. Esterified or disproportionated rosins may also be used in the compositions of this invention. Esterified rosins are rosins which have been reacted with an alcohol which is preferably a polyol such as glycerol. Disproportionated rosins are rosins which have been treated by a catalytic process in order to improve their stability to oxidation. Mixtures of any of these types of rosin may be used in the compositions of this invention.

The preferred rosin for use in the composition of this invention are fortified rosins. The preferred fortified rosins are those wherein the rosin has been reacted with from 5 to 50% of its own weight and generally about 10% by weight of a dienophile. Such rosins comprise a mixture of fortified and unfortified rosin. The two are normally used in combination in view of the fortification which would render the use of a product comprising fortified rosin only prohibitively expensive. The most preferred type of rosin is fortified tall oil rosin.

The amine salt of the rosin acid may be produced by the neutralisation of any of the rosin or rosin derivatives described above. It may be prepared separately and added to the rosin dispersion, but more usually it will be produced in situ by the addition of sufficient amine to bring about the partial neutralisation of the acid content of the rosin. Thus in a preferred embodiment the amine salt is the salt of the rosin acid or acids present in the rosin component of the dispersions of this invention.

The salt of the rosin acid may be produced by neutralising the acid either prior to or after its conversion to a rosin derivative. The neutralisation may be carried out using an amine having the formula:

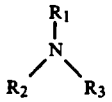

wherein substituents $R_1$, $R_2$ and $R_3$, which may be the same or different, represent alkyl or alkenyl groups comprising from 1 to 4 carbon atoms or a hydrogen atom, with the proviso that at least one of the substituent is not a hydrogen atom. Preferably at least two of the substituents groups $R_1$, $R_2$ and $R_3$ represent alkyl groups and, most preferably, all three of these substituents represent alkyl groups. Those of $R_1$, $R_2$ and $R_3$ which represent alkyl groups may represent branched or straight chain saturated alkyl groups such as methyl, ethyl, or n- or iso- propyl, n-, sec- or tert- butyl groups or they may represent alkyl groups which contain one or more substituent groups such as hydroxyl, alkoxy, carboxy or amino groups such as 2, hydroxyethane groups or hydroxypropane groups. Particular amines which are useful in the composition of this invention include monomethylamine, dimethylamine, trimethylamine, monoethylamine, diethylamine, triethylamine, monopropylamine, dipropylamine, tripropylamine, monoethanolamine, diethanolamine and triethanolamine. The most preferred amine is triethanolamine. The amount of amine which is added to the rosin will be that which is required in order to produce the desired amount of amine salt. Where the product is to be used directly to provide both the rosin component and the amine salt component of the dispersion, the amount of amine which is added will normally be sufficient to neutralise from 1 to 20%, preferably from 3 to 6% of the acid groups present in the rosin. Where the rosin component and amine salt component are prepared separately, and subsequently mixed, the amount of amine salt will normally be such that the mixture comprises the same proportions of neutralised and nonneutralised rosin acids.

The co-reactant component of the dispersions of this invention may be of any of the aluminium salts known to be useful in the sizing of paper such as aluminium sulphate, paper maker's alum $Al_2(SO_4)_3.18H_2O$, polyaluminium chlorides such as those having the formula $$Al(OH)x(SO_4)yCl_z$$

wherein x has a value in the range 1.35 to 1.65, y has a value of from 0.08 to 0.15 and z has a value of 3-(x+y), or those having the formula:

$$Al_n(OH)_mCl_{3n-m}$$

wherein n has a value of from 1 to 20, m is less than 3n and (3n−m) is at least 2 and preferably at least 5.

A particular type of polyaluminium chloride which is useful in the dispersions of this invention are those described in European Patent Application 145686 and those produced by the processes described in European Patent Application 181847. Another type of useful polyaluminium chloride are the aluminium chlorohydrates having the formula:

$$Al_x(OH)_yCl_z$$

wherein x has a value of from 1 to 4, preferably a value of 1, y and z, which may be the same or different, have values of from 0.5 to 2.5 and the ratio y:z has a value in the range 5:1 to 1:5.

The preferred co-reactant for use in the compositions of the present invention are the aluminium chlorohydrates.

The dispersions of the present invention may be prepared by simple admixture of the components thereof or by using any of the conventional techniques of the art. In particular the dispersions may be prepared using the inversion technique.

The rosin, preferably a fortified rosin, optionally treated with para formaldehyde in the presence of a para toluene sulphonic acid to inhibit crystallisation, and optionally one which has been at least partially neutralised with an amine, may be melted and a stabilising agent or mixture of stabilising agents may then be added as a concentrated (e.g. 50% by weight solids) aqueous solution. Sufficient water is stirred in to form a creamy water-in-oil emulsion (e.g. 20 to 40% based on the weight of rosin). On dilution with water the emulsion inverts to provide a stable oil-in-water emulsion, typically having solids content of from 20% by weight up to the maximum achievable oil-in-water concentration (often about 80% by weight solids) and preferably from 30% to 40% by weight solids. The rosin content of the emulsion or dispersion usually contains at least 90% of unsaponified rosin acids. The emulsions may then be blended with an aqueous solution of one or more co-reactants.

The emulsions may be used for sizing paper, including alumed paper.

The rosin dispersions may be formulated so as to comprise other ingredients known in the art. In particular the dispersions may comprise one or more stabilisers. A variety of surface active agents or emulsifiers may be used to stabilise the dispersions either in admixture with one another or with other known emulsifying agents or in conjunction with other known auxiliary stabilising agents. A preferred class of auxiliary stabilising agents are the protective colloids such as casein and compositions comprising rosin, an amine salt of a rosin acid, a co-reactant and a protective colloid form a preferred aspect of this invention. Other compounds which may be used to stabilise the dispersions include starch derivatives, cellulose derivatives such as hydroxyethyl cellulose, or polymeric materials such as polyvinyl pyrolidone.

Anionic, non-ionic, amphoteric, or cationic surfactants may be utilised as stabilisers in the dispersions of this invention. In general we prefer to utilise anionic or non-ionic surfactants.

Examples of surface active agents which find use in the compositions of this invention include (i) salt of sulphonic acids having the general formula:

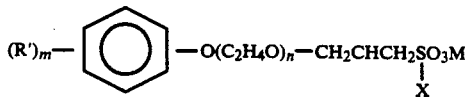

where R′ represents a hydrocarbon residue having from 4–18 carbon atoms, m is an integer having a value of 1 or 2, n is an integer having a value of 4 to 25, X represents a hydrogen atom or a hydroxyl group and M represents a monovalent cation and (ii) salts of sulphuric acid half esters having the general formula:

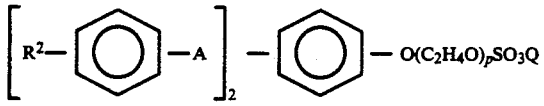

wherein $R^2$ represents a hydrogen atom or an alkyl group having from 1 to 4 carbon atoms, A represents a straight chain or branch chain alkylene group having 2 or 3 carbon atoms, p is an integer having a value of from 4 to 25 and Q is a monovalent cation including all those compounds described in U.S. Pat. No. 4,309,388.

Alkyl benzene sulphonates wherein the alkyl substituent comprises from 8 to 24 carbon atoms including all those compounds described in U.S. Pat. No. 4,157,982.

Sulphosuccinate half esters of fortified rosin having the formula:

$$H_{(3-m)}\cdot R.[(CH_2CH_2O)_n—OC.C_2H_3SO_3Na.COONa]_m;$$

wherein R is a fortified rosin acid tricarboxylate group, m has an average value of from 1.5 to 3, and n has an average value from 4.5 to 25; including all those described in European Patent Application 159794.

Compounds having one of the formula:

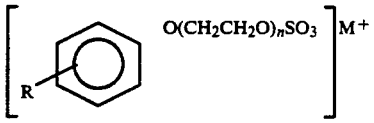

or $$[R'—O(CH_2CH_2O)_nSO_3]M^+$$

wherein R represents an alkyl group comprising from 4 to 18 carbon atoms and R′ represents an alkyl or alkenyl group comprising from 4 to 18 carbon atoms and n is an integer having a value of from 4 to 25 including all those described in U.S. Pat. No. 4,199,367.

Sulphosuccinate salts of ethylene oxide condensates having the general formula:

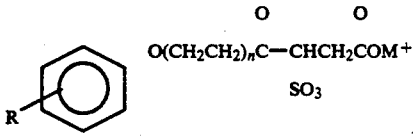

wherein R represents an alkyl group comprising from 4 to 18 carbon atoms and n is an integer having a value of from 4 to 25; including all those compounds described in U.S. Pat. No. 4,203,776.

Organic phosphate esters having the general formulae:

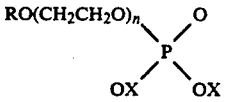

or

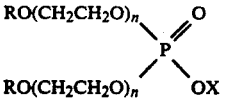

and mixtures thereof wherein R represents an alkyl an alkyl phenol, alkenyl or alkaryl group comprising from 5 to 20 carbon atoms, n has a value of from 5 to 20 and X represents a monovalent cation or hydrogen.

Cationic resin dispersant systems may also be used to stabilise the rosin dispersion of this invention. Examples of suitable materials include water soluable polyaminopolyamide epichlorohydrin resins, water soluble alkylene polyamine epichlorohydrin resins or poly(diallyl-amine) epichlorohydrin resins.

A further type of compound which can usefully be incorporated into the dispersions of this invention is that comprising ammonia or an ammonium salt or a precursor thereof such as urea, a chemically modified urea or a precursor thereof. Examples of compounds which are useful in the compositions of this invention include urea, thiourea, biuret, melamine, water-soluble urea-formaldehyde and melamine formaldehyde resins and derivatives of urea, especially those reaction products obtained by reacting urea with an acid selected from the group comprising sulphamic acid, phosphoric acid, trichloroacetic acid, nitric acid, sulphuric acid, hydrochloric acid, stearic acid and acetic acid as described in U.S. Pat. No. 4,022,634 and 4,093,779, the reaction products of urea with a Lewis acid such a p-toluene sulphonic acid as described in U.S. Pat. No. 4,141,750, the reaction products of urea and sulphamic acid such as are described in U.S. Pat. No. 4,025,354 and the products obtained by the reaction of urea and formic acid as described in U.S. Pat. No. 4,437,894.

The preferred sources of ammonia or ammonium salt for use in the compositions of the present invention are the products obtained by the reaction of urea with sulphamic acid including all those products which are describe in U.S. Pat. No. 4,025,354. These modified ureas may be produced by combining urea with sulphamic acid and water. Ideally, the parts by weight of water equal the parts by weight of urea plus sulphamic acid, although the urea may be treated with the sulfamic acid with more water or with little or no water. The urea-sulphamic acid solution may be heated to a temperature which causes a change in the pH for example to rise in the pH to at least about 7.5.

When little or no water is used the temperature affecting the pH may be higher. In the preferred embodiment, however, where a 50% water-50% urea sulphamic acid solution is used, a temperature of about 212° to 235° F., preferably about 215° to 230° F. will increase the pH up to at least about 7.9. Generally, the solution boils at the temperature which changes the pH and heating should be continued until after boiling has stopped to effect an irreversible pH change. Although the pH range is an important measurement of reaction completion, a more important consideration is the acidity of the first stage product measured as parts of water (ppm). When the sulphamic acid is heated with the urea, undetermined reactions occur which not only raise the pH to a basic value, but also affect the acidity of the solution. The desired minimum acidity is at least 1,000 ppm, with a preferred minimum 4,300. The actual amount of sulphamic acid is probably at least about 0.1% by weight of urea, with preferred amounts ranging from about 0.2% to about 8.0%. The maximum amount of sulphamic acid needed would be 15 or at most 20% by weight of urea to achieve the desired results. It has been found that 5% sulphamic acid produces an acidity of about 86,000 ppm with a pH of between 7.9 and 8.3 when processed in a 50% water, 50% urea plus sulphamic acid solution. Accordingly, sulphamic acid at 0 25% by weight of urea produces a first stage product with an acidity of 4,300 ppm. As indicated, the amount of sulphamic acid added to the solution is not as important as its resulting acidity in defining the first stage product of the novel size composition of this embodiment.

In a preferred embodiment the proportion of ammonia or ammonia salt (or in the preferred embodiment the precursor thereof) to rosin or fortified rosin in the dispersions of this invention may be in the range 5 to 60% and preferably in 10 to 35% by weight.

A further class of ingredients which may usefully be incorporated into the compositions of this invention are the synthetic sizes such as alkenyl succinic anhydrides and especially the alkyl ketene dimers. These reagents may be used as well as or as a partial replacement for the rosin sizes. In general the ratio of the weight of the rosin components to the synthetic size components will be in the range 2:1 to 5:1.

The novel dispersions will normally be formulated as relatively concentrated compositions which are diluted prior to their use in the sizing process. In general, the dispersion will comprise from 25 to 60% and more usually from 30 to 45% by weight of the combined weight of the rosin, amine salt and co-reactant.

The compositions of the invention my be employed as an internal size or as a surface size. Their use as an internal size forms a procerred aspect of the present invention. Internal sizing processes comprise the dilution of the concentrated composition with water and the addition of the diluted composition to a pulp suspension. The amount of size compositon employed is generally in the range 0.1 to 5.0% by weight of solids based on the weight of fibres in the pulp slurry.

The emulsions may be used for sizing paper, including alumed paper.

The emulsions may contain biocides such as bactericides, slimicides and/or fungicides or diluents such as wax.

The invention is illustrated by the following Examples:

EXAMPLE 1

Preparation of a Fortified Rosin and a Dispersion of that Rosin 509 kg of modified tall oil rosin were prepared by reacting a 100 parts of tall oil rosin (ring and ball softening point=60° C.) with 0.1 parts of paratoluene sulphonic acid at a temperature of 165°-175° C. After a 15 minute period 2½ parts of paraformaldehyde (82%) was added over a period of about one hour, maintaining a temperature of 165°-175° C. To this was added 6 parts of maleic anhydride, this was again allowed to react over a period of one hour, after an initial exotherm the temperature was kept at 165°-175° C. The rosin was tested for residual maleic anhydride, using a water wash through a toluene solution of the rosin product.

The fortified rosin was loaded into a one tonne pot using an agitator speed of 300 rpm, water and 10 kg of triethanolamine was added both to cool and partially neutralise the rosin product.

When the temperature had dropped to below 100° C. a solution comprising 10 kg of casein, 2 kg of borax and 60 kg of water at 89° C. were added quickly to effect inversion.

After allowing to thicken for a period not exceeding 5 minutes the emulsion was diluted.

EXAMPLE 2

509 kg of a rosin product as produced in Example 1 were loaded into a one tonne pot using an agitator speed of 300 rpm, water and 10 kg of triethanolamine was added.

When the temperature had dropped below 100° C. a solution comprising 7 kg casein, 1½ kg borax, 5 kg of an organic phosphate ester surfactant, as described previously, and 60 kg of water at 80° C. were added quickly to effect inversion.

EXAMPLE 3

Preparation of a modified urea 358 kg of urea was placed into a 2 tonne vessel capable of both stirring and heating the resulting solution. 600 kg of water was added. Heating and stirring was commenced. To this was added 18 kg of sulphamic acid. After a solution was achieved the acidity was measured and found to be 20,000 ppm. After 1¼ hours of stirring and when boiling (103° C.) had ceased the acidity was measured at 0 ppm.

EXAMPLE 4

Preparation of a Rosin Dispersion Comprising a Co-Reactant 800 kg of the 30% rosin emulsion produced in Example 2 was placed into a 3 tonne production unit. To this was added 400 kg of a 30% urea solution. The stirrer was switched on at 3,000 rpm (Greaves mixer). To this was added quickly (1-5 secs) 160 kg of an aluminium chlorohydrate solution. An additional 640 kg of the aluminium chlorohydrate solution was added over a period of one minute. The stirrer was switched off and the product filtered through a 40 mesh filter basket.

EXAMPLE 5

A dispersion was produced using the ingredients and procedures described in Example 4, except a 30% Lewis acid reacted urea was substituted for the 30% urea solution.

EXAMPLE 6

A dispersion was produced using the ingredients and procedures described in Example 4, with the exception that no urea was added.

EXAMPLE 7

A dispersion was produced using the ingredients and procedures described in Example 4, except that a polyaluminium chloride was substituted for the aluminium chlorohydrate.

EXAMPLE 8

A dispersion was produced using the ingredients and procedures described in Example 4, except that aluminium sulphate (paper maker's alum) was substituted for the aluminium chlorohydrate.

EXAMPLE 9

A dispersion was produced using the ingredients and procedures described in Example 4, except that 50 mole % of the aluminium chlorohydrate was substituted with a polyaluminium chloride.

EXAMPLE 10

Sizing tests were carried out as follows:

Bleached sulphite pulp was beaten to Schopper Reigler 40° at 2% consistency.

To 600 cc of this pulp was added 800 cc of water and sufficient sizing agent to give the level listed in Table II. This was mixed gently.

A further 1 liter of water was added and sufficient sulphuric (0.1N) acid to control the pH to 6.5 after 30 mins standing. Sheeets were prepared on a British standard sheet former. The wet sheets were blotted off the wire, pressed at 50 psi for 5 minutes and dried at 95° C. for 4 minutes on a photographic print drier. After overnight conditioning the sizing efficiency was assessed using the Cobb test (1 minute).

TABLE I

Internal Sizing
(a) Bleached sulphite Schopper Reigler = 40°
(b) 100 gsm
(c) No additional flocculants added
(d) Final thin stock pH = 6.5

| Product of Example | % Rosin/Fibre | 24 Hour conditioned Cobb 60 seconds |
|---|---|---|
| 4 | 0.4 | 25.7 |
| | 0.6 | 25.4 |
| | 0.8 | 22.2 |
| 7 | 0.4 | 35.6 |
| | 0.6 | 25.4 |
| | 0.8 | 23.9 |
| 8 | 0.4 | 30.0 |
| | 0.6 | 23.4 |
| | 0.8 | 22.8 |
| 9 | 0.4 | 34.1 |
| | 0.6 | 25.9 |
| | 0.8 | 23.8 |

The external, (surface sizing) was simply carried out by drawing paper through a trough of the diluted sizing agent, weighing and drying.

External Sizing - Surface
(a) Waste furnishing Schopper Reigler = 40°
(b) 100 Gsm
(c) No additional flocculants added

| Product of Example | % Rosin/Fibre | 24 Hour conditioned cobb 60 seconds |
|---|---|---|
| 4 | 0.055 | 50 |
| | 0.075 | 19.4 |
| | 0.111 | 18.5 |
| | 0.222 | 17.8 |
| | 0.333 | 18.5 |

We claim:

1. A paper-sizing composition in the form of a preformed stable aqueous dispersion for subsequent use in a paper-sizing process, said composition having the ability to size paper stock, sheet or web to an effective extent, without the necessity to add any further materials, when brought into contact with said stock, sheet or web during said sizing process, the composition comprising:

(a) a rosin size, (b) an amine salt of a rosin acid, said amine salt being the salt of rosin acid and a $C_1$–$C_4$ mono-, di- or tri-alkanolamine; and (c) a polyaluminum chloride.

2. A composition according to claim 1, wherein the amine salt of a rosin acid is added to a rosin dispersion comprising the rosin size component of the composition.

3. A composition according to claim 1, wherein the amine salt of a rosin acid is formed by the partial neutralisation of the acid content of a rosin dispersion comprising the rosin size component of the composition.

4. A composition according to claim 2, wherein the amine salt of a rosin acid is produced by neutralisation of the resin acid prior to or after its conversion to a rosin derivative.

5. A composition according to claim 1, wherein the aluminum compound polyaluminum chloride is an aluminum chlorohydrate having the formula:

$$Al_x(OH)_yCl_z$$

wherein x has a value of from 1 to 4, preferably a value of 1, y and z, which may be the same or different, have values of from 0.5 to 2.5 and the ratio y:z has a value in the range 5:1 to 1:5.

6. A composition according to claim 1, wherein at least one stabilizer, optionally in conjunction with at least one auxiliary stabilising agent, is present.

7. A composition according to claim 6, wherein the stabiliser is selected from protective colloids, starch derivatives, cellulose derivatives, polymeric materials and anionic, nonionic, cationic and amphoteric surfactants, water-soluble polyamminopolyamide/epichlorohydrin resins, water-soluble alkylenepolyamine/epichlorohydrin resins and poly(diallylamine)/epichlorohydrin resins.

8. A composition according to claim 1, wherein at least one alkenyl succinic anhydride or alkyl ketene dimer synthetic size is incorporated into the composition.

9. The composition of claim 1, wherein said amine is monoethanolamine or diethanolamine.

10. The composition of claim 1, wherein said amine is triethanolamine.

11. The composition according to claim 1, wherein the polyaluminum chloride is a compound of the formula:

$$Al(OH)_x(SO_4)_yCl_z$$

wherein n has a value in the range from 1.35 to 1.65, y has a value of from 0.08 to 0.15 and z has a value of $3-(x+y)$, or an aluminum chlorohydrate having the formula:

$$Al_n(OH)_mCl_{3n-m}$$

wherein n has a value of from 1 to 20, m is less than 3n and $3n-m/m$ is at least 2.

12. The composition according to claim 11 further comprising urea or a chemically modified urea.

13. The composition according to claim 11 comprising 25% to 60% by weight of components (a), (b) and (c) in an aqueous dispersion.

14. The composition according to claim 11, wherein the polyaluminum compound is aluminum chlorohydrate.

15. A composition according to claim 1, wherein the amine salt is present in an amount representing from 1% to 20% of neutralisation of the acid groups present in the rosin component.

16. A composition according to claim 13, which has been prepared by an inversion technique.

17. A method of manufacture of a paper-sizing composition, which comprises first forming an aqueous dispersion comprising a rosin size and an amine salt of a rosin acid and then introducing at least one aluminum compound into the dispersion and wherein said amine salt of a rosin acid is a salt of a rosin acid and a $C_1$ to $C_4$ mono-, di- or tri-alkanolamine; and said aluminum compound is a polyaluminum compound.

18. A method according to claim 17, wherein a water-in-oil emulsion comprising the rosin component and at least one stabilizer is made and is then subjected to an inversion technique so as to form the desired composition in the form of an oil-in-water emulsion, which is then blended with at least one co-reactant.

19. The method according to claim 17, wherein the amine salt is formed by addition of free amine to the rosin acid to effect partial neutralisation of the rosin acid component of said rosin size.

20. The method according to claim 17, wherein the amine salt is formed separately and subsequently added as such to the rosin size.

21. In a process of manufacture of a sized paper product, wherein a paper sizing composition is added to fibre stock which is then made into paper or is applied as a surface size to a prepared paper web or sheet, the improvement comprising the paper sizing composition comprises an aqueous dispersion containing a rosin size component and a co-reactant therefor comprising an aluminum compound and an amine salt of a rosin acid and wherein said amine salt of a rosin acid is the salt of rosin acid and a $C_1$–$C_4$ mono-, di-, or tri-alkanolamine; and said aluminum compound is a polyaluminum chloride.

22. A process according to claim 21, wherein the composition is employed in an amount in the range from 0.1% to 5.0% by weight of solids based on the weight of the fibres in the pulp used to make the paper product.

* * * * *